US007739753B2

(12) United States Patent
Jankowski

(10) Patent No.: US 7,739,753 B2
(45) Date of Patent: Jun. 22, 2010

(54) PROTECTIVE ELASTIC SUPPORT TOP AND BREAST SHIELD

(76) Inventor: Susan Charlotte Jankowski, 121 Palm La., Islamorada, FL (US) 33036

( * ) Notice: Subject to any disclaimer, the term of this patent is extended or adjusted under 35 U.S.C. 154(b) by 1120 days.

(21) Appl. No.: 10/407,374

(22) Filed: Apr. 5, 2003

(65) Prior Publication Data

US 2004/0198177 A1 Oct. 7, 2004

(51) Int. Cl.
*A41D 13/00* (2006.01)
*A41C 3/00* (2006.01)

(52) U.S. Cl. ..... 2/463; 2/92; 2/455; 450/39; 450/57; 450/54

(58) Field of Classification Search ..... 2/455, 2/463, 92, 2.5, 267, 268, 73, 46, 48, 50–52, 2/49.1–49.5; 450/39, 53, 54–57, 30–32, 450/79–82

See application file for complete search history.

(56) References Cited

U.S. PATENT DOCUMENTS

| | | | | | |
|---|---|---|---|---|---|
| 3,221,748 | A | * | 12/1965 | Glasser | 450/54 |
| 5,022,887 | A | * | 6/1991 | Lawson | 450/54 |
| 5,244,432 | A | * | 9/1993 | Moy Au et al. | 450/54 |
| 5,769,688 | A | * | 6/1998 | Holliday | 450/57 |
| 6,083,080 | A | * | 7/2000 | Lawson et al. | 450/39 |
| 6,110,005 | A | * | 8/2000 | Stephenson et al. | 450/39 |
| 6,145,134 | A | * | 11/2000 | Davis et al. | 2/463 |

OTHER PUBLICATIONS

Self-Abhering Nylon Tapes; Gershman, Maurice; Journal of the American Medical Assn. vol. 68 # 7.*

* cited by examiner

*Primary Examiner*—Gloria Hale

(57) ABSTRACT

An elastic support top 1 is provided having fasteners 4, 5 for attaching to a breast shield 10 for protecting from blows to the breast area. Thus, an improved protective breast shield 10 is provided having an elastic support top 1 attached to the breast shield whereby the support top fits to a body.

8 Claims, 7 Drawing Sheets

PROTECTIVE ELASTIC SUPPORT TOP AND BREAST SHIELD

FIELD OF THE INVENTION

This invention relates in general to a protective shield for the breast area, and more particularly to an elastic support top having fasteners for attaching the support top to the protective shield.

BACKGROUND TO THE INVENTION

In many sports and even in some industry, it is important to protect parts of the body. Helmets, shin guards, teeth guards and even guards for the male groin area are available for impact protection in a variety of sports. However, there is little protection available for the chest area. Protecting the chest area from impact is becoming more important. Blows to the chest area can cause damage to the rib cage, heart and lungs. Females have further vulnerability due to having breasts. There are an increasing number of girls and women participating in sports and there is a lack of protective equipment designed for such females to wear.

In all sports, such as basketball, baseball, softball, and football there are a number of events that cause blows to the chest area of a player. Such blows can be from other players, equipment or the balls used during play of the sport. In soccer, blows from a hard soccer ball are often suffered to the breast and chest area. The ball may be kicked or even thrown by another player. Particularly, if kicked, the impact from the ball to a breast area can be substantial. In men's soccer, men are at an advantage because an effective maneuver is to hit a high ball with the chest area. Without a protective shield such a maneuver would be painful and may cause damage to a female.

The breast area of female includes very sensitive breast tissue. It is not desirable nor is healthy to have such sensitive tissue hit or damaged. In fact, there has been some research that has shown that damage to the breast area may result in a future cancer site. Therefore, it has become even more imperative to protect the breast area of women of all ages, including young girls.

U.S. Pat. No. 6,375,537 for a Breast Shield Protector discloses a breast shield having an outer layer and an inner layer. The outer layer is made of an impact resistant material. The inner layer is attached to an inside of the outer layer and the inner layer is made of a soft material. There are straps attached to breast shield for attaching the breast shield to a body. The straps must be strapped around a body and secured to the breast shield. If an adolescent female is wearing the breast shield she may wear a sports bra under the breast shield. Thus, the breast shield may not be held in place as well as if secured directly to the body. The breast shield may slip or slide around the chest area due to sports bra slipping or sliding. As the breast shield slips it becomes less effective.

Thus, there is a need to provide a sports bra or support top that is attachable to an improved breast protector that works as an integral system to stay firmly put on the body providing optimum protection for the chest area.

SUMMARY OF THE INVENTION

According to the present invention an elastic support top for attaching to a protective breast shield is provided comprising at least two fasteners for attaching the support top to the breast shield. Thus, an improved protective breast shield is provided having an elastic support top attached to the breast shield whereby the support top fits to a body.

DETAILED DESCRIPTION OF THE PREFERRED EMBODIMENT

Figure 1:
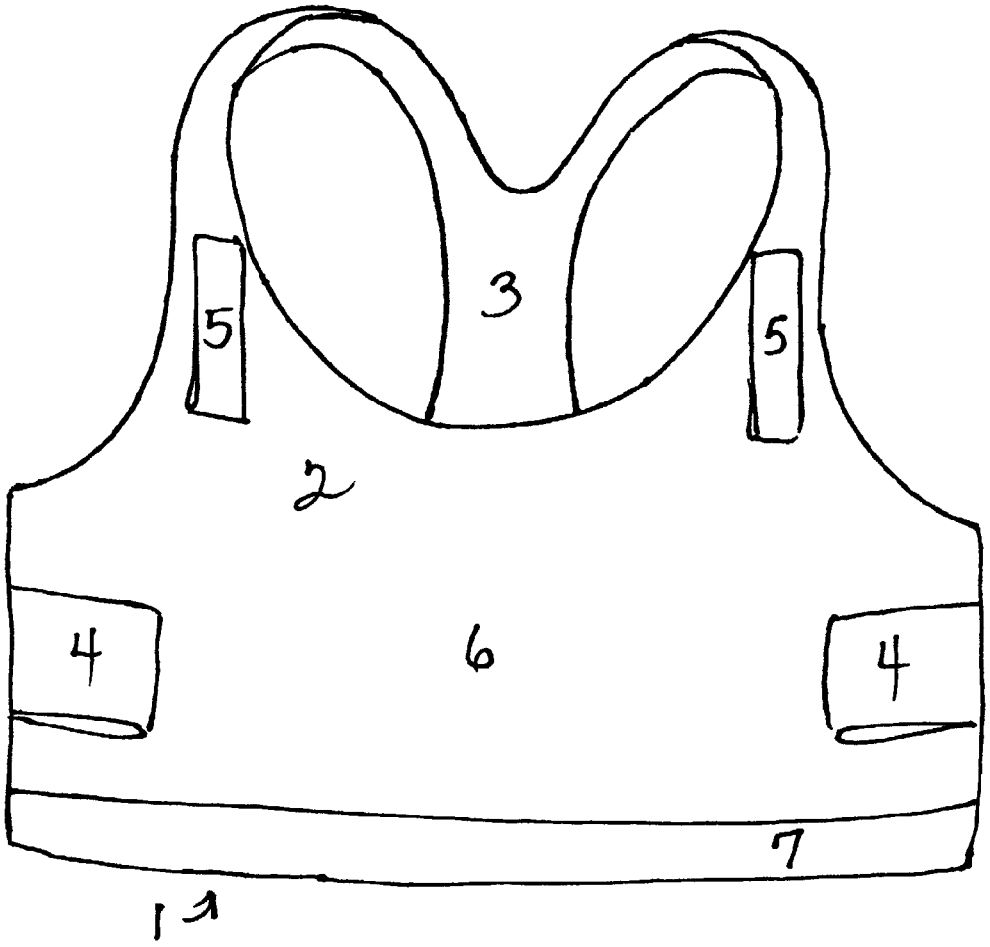
FIG. 1 shows a front view of an elastic support top according to an embodiment of the present invention.

This invention is described with reference to the Figures. FIG. 1 shows an elastic support top 1. The elastic support to may be made of any elastic fabric such as cotton, nylon, polyester, spandex or any combination thereof or any other textile fabric or combination with elastic properties. The present invention contemplates fabrics of different elasticity with varying degrees of ventilation. The elastic support top may be made similar to those sports bras already available to the public.

The elastic support top 1 is made to support the breast area during sporting activities. The breast area of a female must be firmly supported but may also be compressed when the support top 1 is placed on the body. Such compression provides further support for the breast area. The compression in the breast area may be created by varying density of elastic fabric covering the breast area. For instance, the elastic fabric in the breast area may be made of denser fabric with more elasticity. More than one layer of fabric may also be used.

The elastic support top 1 includes a front side 6 and an outside or outside layer 2. An inside or inside layer 3 of the elastic support top 1 is fitted next to a body. The present invention may be made of one layer having an outside 2 and an inside 3. However, another embodiment may have two layers, an outside layer 2 and an inside layer 3. One layer may be made of stronger or denser fabric with more elasticity in the breast area for more support.

The outside or outside layer 2 is attachable to a protective breast shield 10, as shown and described later with reference to FIG. 7, by at least two fastener means or fasteners 4. The fasteners 4 may be VELCRO (or hook and loop fasteners). Any variation of fastener means may be used. The fasteners 4, shown on the front side 6 and outside layer 2, are shown dosed and not attached to a breast shield. The fasteners 4, 5 are used to attach a protective breast shield 10 (FIG. 7) to the support top 1.

FIG. 1 further shows two additional fasteners 5. These fasteners 5 are also used to attach the breast shield to the support top 1. These four fasteners 4, 5 are placed strategically on the support top 1 to hold the breast shield firmly in place while on a body. The fasteners 4, 5 may also be located and oriented to create opposing forces to stabilize the breast shield with the support top 1 while on a body. The fasteners 4, 5 may be placed or oriented in any manner on the support top 1 in order to best utilize a protective breast shield.

Figure 2:
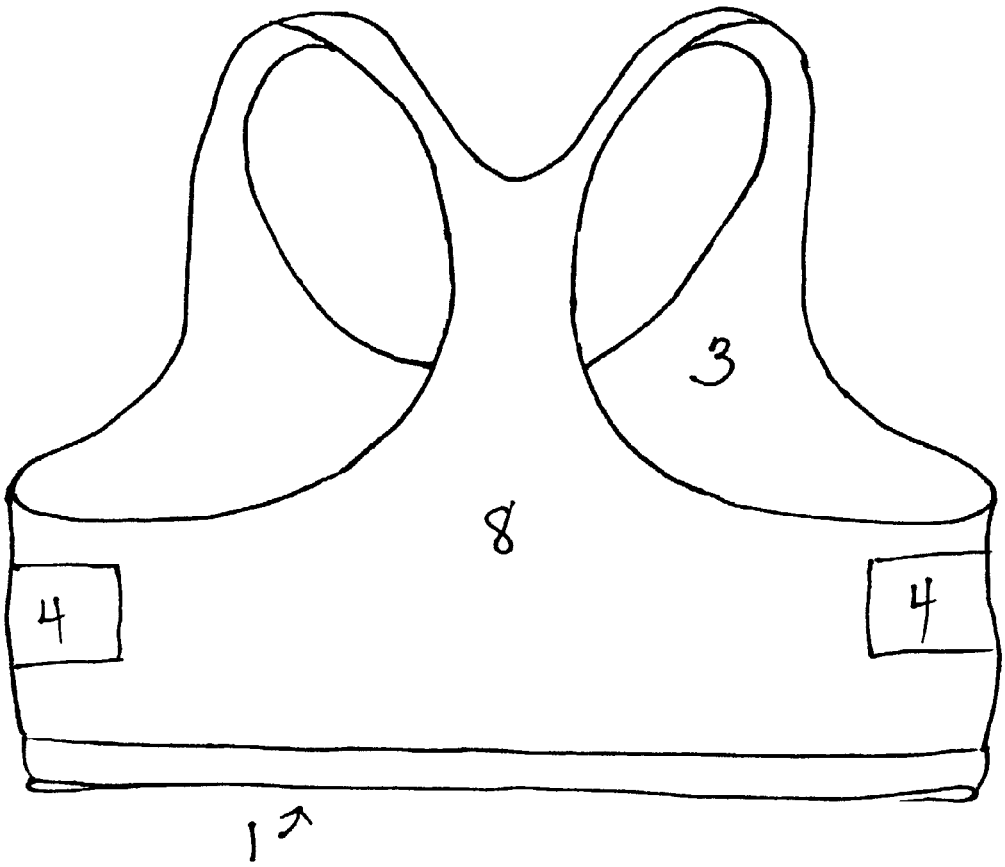
FIG. 2 shows a back view of an elastic support top according to an embodiment of the present invention.

FIG. 2 shows a back view of the elastic support top 1 according to an embodiment of the present invention. The fasteners 4 are shown closed and reaching around to the backside 8 of the support top 1. The style of the backside 8 is shown to be of a typical sports bra type but may be varied in other embodiments of the present invention.

Figure 3:
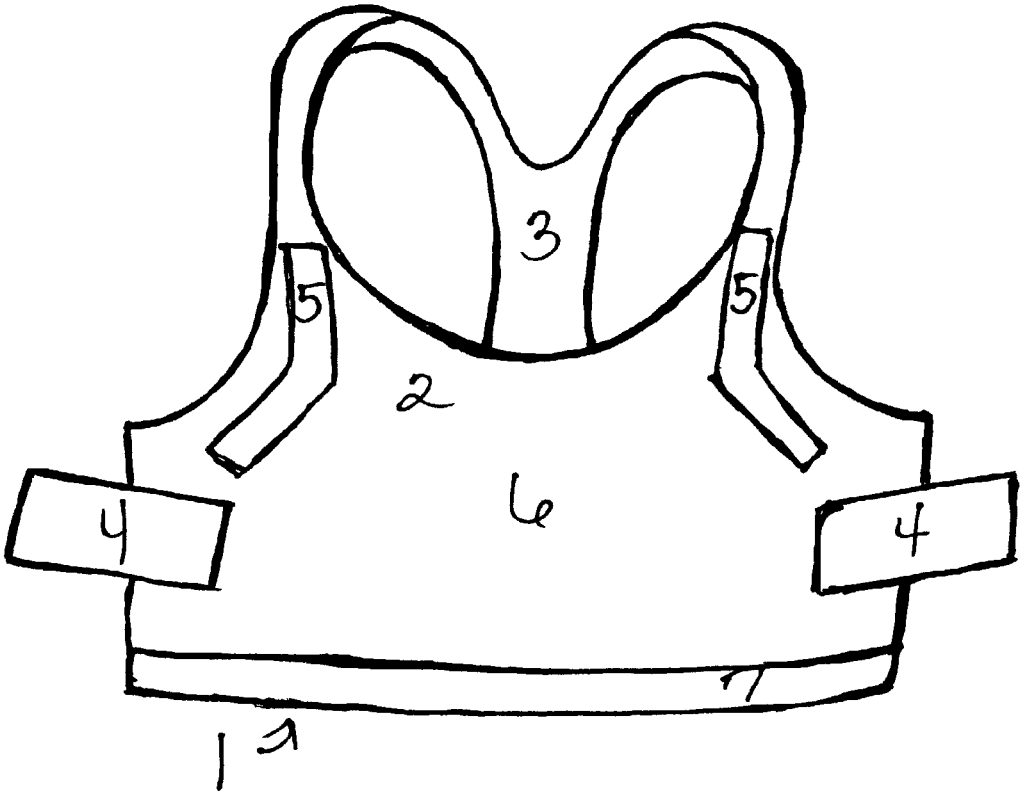
FIG. 3 shows a front view of an elastic support top according to an embodiment of the present invention.

FIG. 3 shows a front view of an elastic support top 1 according to an embodiment of the present invention. The fasteners 4, 5 are shown open and ready to receive a protective breast shield device.

Figure 4:
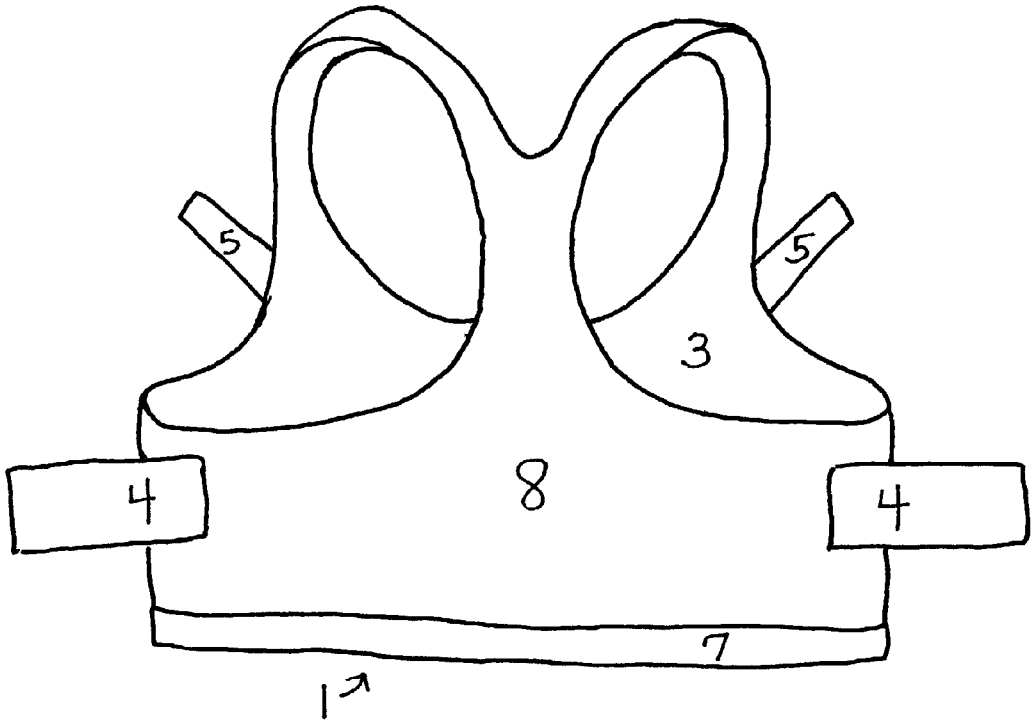
FIG. 4 shows a back view of an elastic support top according to an embodiment of the present invention.

FIG. 4 shows a back view of an elastic support top 1 with according to an embodiment of the present invention. The fasteners 4, 5 are shown open. The bottom 7 of the support top 1 may be made of a material having stronger elastic properties than the rest of the support top 1 so that the support top 1 will stay down under the breast area and stay in place on a body. For example, the bottom 7 may be an edge or a border at the bottom 7 of the support top 1 made up of material like the rest of the support top with a strip of elastic rubber running through it.

Figure 5:
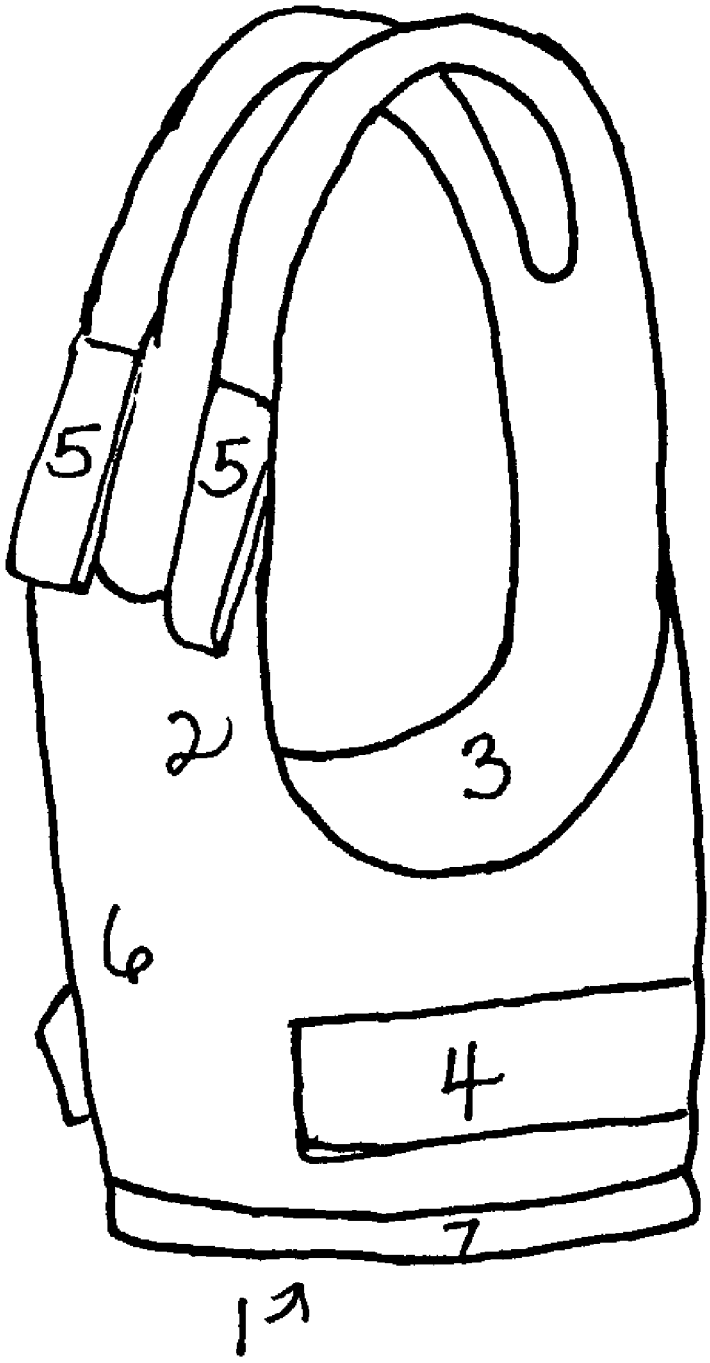
FIG. 5 shows a side view of an elastic support top according to an embodiment of the present invention.

FIG. 5 shows a side view of an elastic support top 1. The fastener 4, 5 are shown closed.

Figure 6:
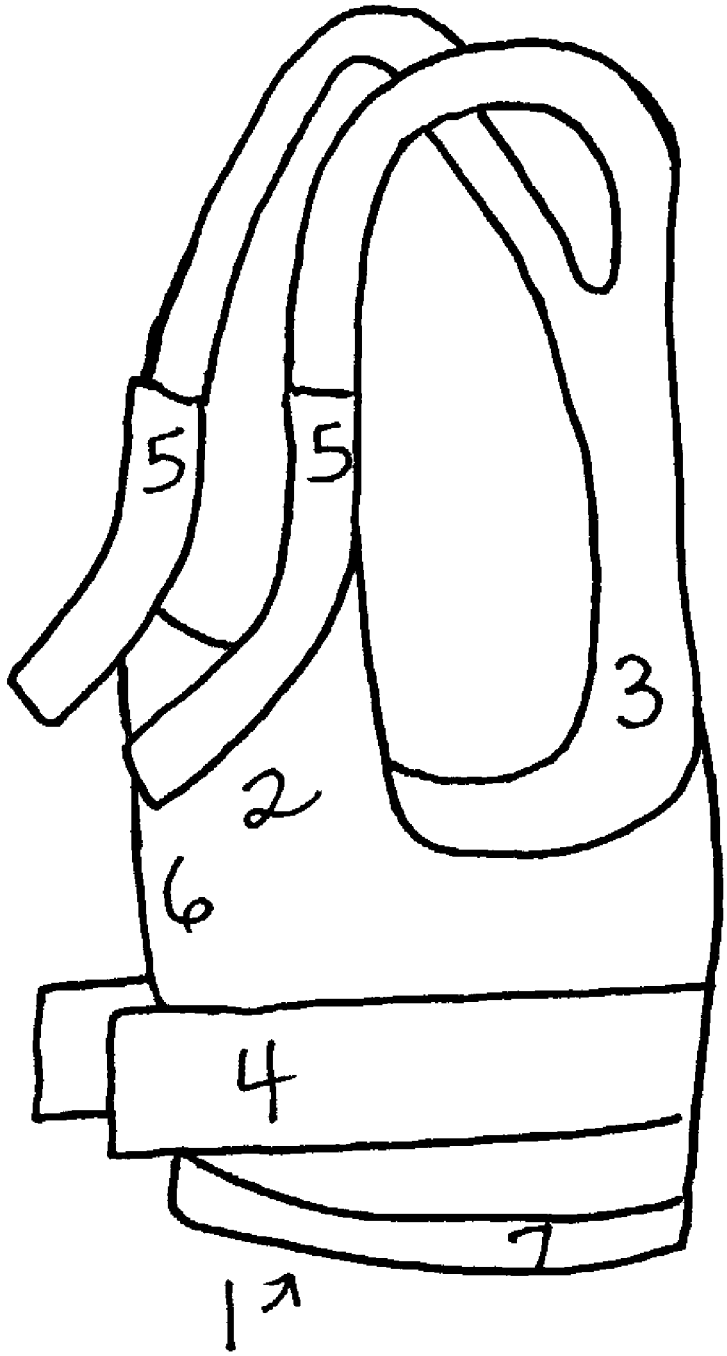
FIG. 6 shows a side view of an elastic support top according to an embodiment of the present invention.

FIG. 6 shows a side view of an elastic support top 1 with the fasteners 4, 5 open.

Figure 7:
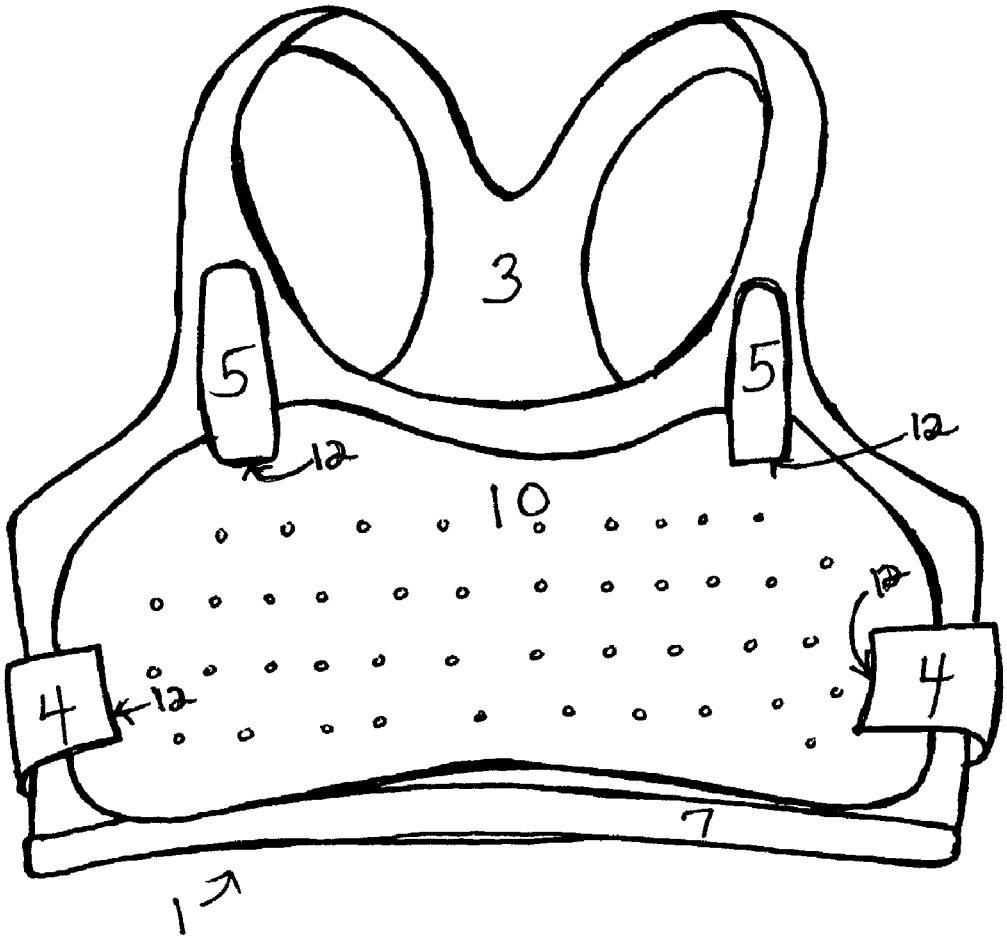
FIG. 7 shows a front view of an improved protective breast shield attached to an elastic support top according to an embodiment of the present invention.

FIG. 7 shows a front view of an improved protective breast shield 10 attached to an elastic support top 1 according to an embodiment of the present invention. The breast shield 10 may be made as disclosed in U.S. Pat. No. 6,375,537 for a Breast Shield Protector. The breast shield 10 has means for receiving the fasteners 4, 5 of the support top 1. Such means may be slits 12 cut in the breast shield in respective places to receive the fasteners 4, 5 of the support top. The fasteners 4, 5 are shown threaded through the slits 12 of the breast shield 10 in FIG. 7.

The support top 1 may be put on a body first. Then after the support top is fitted to the body, the breast shield 10 may be attached to a front side or outer layer of the support top 1. The improved protective breast shield 10 of FIG. 7 shows the elastic support top 1 as attachable to the breast shield by for fasteners or straps 4, 5. The straps 4, 5 are for threading through complementary slits 12 on the breast shield 10 and used to tighten the breast shield 10 to the support top 1. The slits 12 are shown as two slits 12 located one each on top opposite sides of the breast shield 10 for receiving straps 5 from above the breasts on the support top 1 and as two slits 12 located on the opposite sides of the breast shield 10 so as to receive straps 4 from the sides of the support top 1. When removing from a body the breast shield 10 may be first unfastened from the support top 1. The support top 1 and detachable breast shield 10 are easily cleaned as separate pieces.

The fasteners 4, 5 are strategically placed on the improved breast shield 10. The fasteners 4, 5 and their respective the slits 12 of the improved breast shield 10, are strategically placed so that the fasteners 4, 5 hold the breast shield firmly in place with the support top 1 on a body. The fasteners 4, 5 are located and oriented to create opposing forces to stabilize the improved breast shield 10 with the support top 1 while on a body. The fasteners 4, 5 may be hook and loop fasteners. The hook and loop fasteners may thread through the slits 12 of the breast shield 10 then fold over and attach to themselves respectively. The Velcro strips may be adjusted individually to optimally tighten and orient the improved breast shield 10 on a body.

Thus, the present invention provides an elastic support top 1 for attaching to a breast shield 10 to protect the chest area from blows during any physical activity. The support top 1 adds strength and versatility to a female's athletic prowess in sports such as soccer where there are a number of blows to the breast area in each practice and game.

The present invention also provides an improvement to present breast shield devices by having an integral support top 1 that is attachable to the breast shield 10. The combination creates an optimally fitted protective device for the chest area. The improved protective breast shield 10 of the present invention is designed to allow females the ability to fully and freely engage in many sports or other activities without risking injury to their breast area.

The invention claimed is:

1. A protective breast shield and an elastic support top, in combination, comprising:

an elastic support top, including a front side and a back side, formed of an elastic material to provide support to a wearer's breast:

said elastic support top having straps attached to the front side of the support top for attaching the protective breast shield to the support top front side; and a single piece protective breast shield structured to cover the entire breast and sternum areas of the wearer's body on the front side of the elastic support top: said protective breast shield having slits therein in locations complementary to the support top straps: said slits to thereby receive the straps attached to the front side of the elastic support top wherein when said straps are placed through the slits, the shield is thereby securely fastened in place onto the front side of the elastic support top.

2. The protective breast shield and elastic support top combination, of claims 1 wherein the elastic support top is removably attached to the breast shield by at least two said straps on said elastic support top received through at least two of said complementary slits.

3. The protective breast shield and elastic support top combination, of claim 1 wherein the elastic support top is removably attached to the breast shield by four of said straps on said elastic support top received through four of said complementary slits.

4. The protective breast shield and elastic support top of claims 1 wherein said support top straps each include hook and loop fasteners to secure said strap after it is placed through the complementary slits on said protective breast shield to thereby firmly secure said protective breast shield onto the support top worn by the wearer.

5. The protective breast shield and elastic support top combination as claimed in claim 2 wherein the straps are located on opposite sides of the support top and the complementary slits are located on opposite sides of the protective breast shield for complementary attachment of said straps through said complementary slits.

6. The protective breast shield and elastic support top combination as claimed in claim 3 wherein the straps are located on opposite sides and top opposite corners of the support top and the complementary slits are located on opposite sides and opposite corners of the protective breast shield for complementary attachment of said straps through said complementary slits.

7. The protective breast shield and elastic support top combination, of claim 2 wherein the straps are sewn on the support top.

8. The protective breast shield and elastic support top of claim 2 wherein said support top straps each include hook and loop fasteners to secure said strap after it is placed through the complementary slits on said protective breast shield to thereby firmly secure said protective breast shield onto the support top worn by the wearer.

* * * * *